US010188892B1

(12) United States Patent
Gvoich

(10) Patent No.: US 10,188,892 B1
(45) Date of Patent: Jan. 29, 2019

(54) METHOD AND APPARATUS FOR MULTI-PURPOSE BOX TRAINING SYSTEM

(71) Applicant: Gvoich Fitness Systems, Baton Rouge, LA (US)

(72) Inventor: William Gvoich, Baton Rouge, LA (US)

( * ) Notice: Subject to any disclaimer, the term of this patent is extended or adjusted under 35 U.S.C. 154(b) by 0 days.

(21) Appl. No.: 15/948,555

(22) Filed: Apr. 9, 2018

Related U.S. Application Data

(63) Continuation-in-part of application No. 15/068,207, filed on Mar. 11, 2016, now Pat. No. 9,937,373.

(60) Provisional application No. 62/132,576, filed on Mar. 13, 2015.

(51) Int. Cl.

| | |
|---|---|
| ***A63B 21/06*** | (2006.01) |
| ***A63B 21/072*** | (2006.01) |
| ***A63B 21/00*** | (2006.01) |
| *A63B 23/035* | (2006.01) |
| *A63B 21/075* | (2006.01) |

(52) U.S. Cl.
CPC ..... *A63B 21/0605* (2013.01); *A63B 21/0722* (2015.10); *A63B 21/0728* (2013.01); *A63B 21/4035* (2015.10); *A63B 21/075* (2013.01); *A63B 21/0724* (2013.01); *A63B 21/0726* (2013.01); *A63B 23/03508* (2013.01); *A63B 23/03525* (2013.01); *A63B 23/03541* (2013.01)

(58) Field of Classification Search
CPC ..... A63B 21/0605; A63B 21/4035; A63B 21/072; A63B 21/0726; A63B 21/075; A63B 21/0728; A63B 21/0724; A63B 23/03508; A63B 23/03525; A63B 23/03541; A63B 71/0036; A45C 5/00
See application file for complete search history.

(56) References Cited

U.S. PATENT DOCUMENTS

| | | | | |
|---|---|---|---|---|
| 4,431,185 A * | 2/1984 | Cisneros | A63B 21/072 220/318 |
| 6,123,651 A * | 9/2000 | Ellenburg | A63B 71/0036 482/104 |
| 7,011,611 B1 * | 3/2006 | Ripley | A63B 21/0728 482/107 |
| 7,458,920 B2 * | 12/2008 | Hallar | A63B 21/06 206/303 |
| 8,834,330 B1 * | 9/2014 | Morales | A63B 21/0605 482/107 |
| 9,550,088 B2 * | 1/2017 | Coompol | A63B 21/0724 |

* cited by examiner

*Primary Examiner* — Megan Anderson
(74) *Attorney, Agent, or Firm* — Ted M. Anthony

(57) ABSTRACT

A multi-purpose box training system apparatus that is designed to enable a user to train his or her entire body in an effective and safe manner.

20 Claims, 13 Drawing Sheets

METHOD AND APPARATUS FOR MULTI-PURPOSE BOX TRAINING SYSTEM

CROSS REFERENCES TO RELATED APPLICATION

This Application is a continuation-in-part of U.S. Non-Provisional patent application Ser. No. 15/068,207, filed Mar. 11, 2016, currently pending, that claims priority of U.S. Provisional Patent Application Ser. No. 62/132,576, filed Mar. 13, 2015, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for use in strength and fitness conditioning. More particularly, the present invention pertains to a multi-functional training apparatus and method that permits versatile training with key exercises in an effective and functionally progressive manner using a single device.

2. Brief Description of the Prior Art

Muscular strength and endurance play an important role in enabling a person to perform physical activity in any number of different circumstances including, without limitation, at work, home, an outdoor setting, or while participating in a sporting activity. However, due to a recent epidemic of inactivity and obesity in many adults and children, many people have lost the ability to effectively perform certain basic physical functions that enable people to effectively carry out daily physical demands of everyday life. As a result, this loss of basic physical fitness can have a variety of detrimental effects, such as, for example, by creating muscle imbalance and physical weakness, increasing the likelihood of injury, and causing a change in body composition due to a loss of muscle mass.

Conventional exercise and strength-training equipment found in gyms and fitness facilities suffer from various design deficiencies. Importantly, such conventional strength-training machines do not engage the body's balance and stability functions during exercise performance. Most conventional strength-training equipment has a fixed linear exercise movement or motion, which is dictated by a machine that is generally unable to mimic a particular body movement used in a normal physical activity. Further, many machine exercises are performed in a sitting position, which fails to sufficiently engage and strengthen core muscles of the body (abdomen, lower back, and hips) that play an important role in providing stability when performing physical tasks, effectively and safely from a standing position, with correct posture and body alignment.

Moreover, different muscles and muscle groups within the human body do not work in isolation—multiple muscles work in tandem, as a team. As a result, conventional exercise machines and strength-training equipment will not correct a weak link in a kinetic chain, when multiple muscles within the human body work in sequence to perform a physical task. Instead, conventional strength-training machines generally isolate a muscle group, and therefore, are unable to address weak link(s) in total body muscle integration, as required for functional strength.

Generally, in order to maximize a transfer of strength benefits that are gained in a gym setting to another activity (such as, for example, on a playing field or when performing a physical task encountered in activities of daily life) a person must: exercise the muscle groups in a manner that approximates a real life activity; engage core muscle groups (such as, deep abdominals, lower back, and hip muscles); perform exercise movements on a variety of different planes of motion and ranges of motion, as required by the real life physical tasks; perform exercise movements in a standing (not seated) position; and, perform exercise movements in a functionally progressive sequence, in order to accommodate a variety of function levels of multiple individuals.

Thus, there is a need for a versatile strength-training and fitness apparatus, and associated method of using same, which can better prepare the human body for real-world physical demands. The apparatus should be inexpensive, easy to use and effective. Further, the apparatus should permit a user to train multiple different muscle groups—and ideally the whole body—in a safe and effective manner.

SUMMARY OF THE INVENTION

The present invention comprises a multi-purpose training apparatus, and method of using same, that provides an innovative approach to functional strength training (in order to improve physical performance and to better prepare a human body for real-life physical demand.) The box training apparatus of the present invention enables a user to train his or her entire body by using a plurality of key strength exercises in an effective, safe, and functionally progressive manner.

The box training apparatus of the present invention generally comprises a box member having four (4) substantially planar side members of substantially equal size, joined to form four (4) right (90°) angles, as well as a substantially planar back member. Said side members and back member cooperate to define an inner chamber. A substantially rigid rod member extends from said back member into said inner chamber of said box member (typically in a perpendicular orientation relative to said back member) in order to allow at least one additional source of weight or resistance, to be received on said rod member.

Further, said side members have a plurality of apertures having predetermined shapes, sizes and spacing; said apertures cooperate to define handles or cross members (that is, portions of said side members) that allow a user to hold said box training member in a variety of different positions and/or hand grips. Additionally, the box training member comprises a first removable dowel member—for use in allowing a user to perform alternate exercise movements, with additional hand grips. A user can selectively hold said box member with one arm or two arms, with or without said optional dowel member. Alternatively, multiple box members can be operationally supported by a single (typically longer) second removable dowel member.

The present invention permits a user to transfer a fitness result that can be produced in a gym setting to a real-life activity. The box training apparatus of the present invention comprises a relatively comfortable design that a user can identify with, thereby instilling a sense of familiarity when a user is being introduced to a new skill. In addition, the box training apparatus has an appearance that is different from a conventional exercise machine, dumb bell, bar bell, or other conventional exercise equipment, thereby lowering an intimidation factor that a user could face when using a conventional exercise machine or a free weight typically found in a gym setting.

The present invention represents an improvement over a conventional exercise and strength-training technology because it utilizes a multi-purpose design and function, thereby allowing for whole-body training using a simple, safe, and multi-functional exercise device. The box training apparatus has a variety of grip and dowel member options that allow a user to progress through a range of activity-based exercises without having to use multiple devices or machines. Therefore, the present invention provides a user with a functional capacity beyond that which is provided by existing exercise and strength-training devices.

The box training apparatus of the present invention can be beneficially used by an individual with or without an instructor. When an individual uses the apparatus without an instructor, a manual or online training tutorial can provide a user with guidance on how to properly use said box training apparatus, and how to perform various exercises with said box training apparatus.

The box training apparatus of the present invention enables a user to perform a wide variety of dynamic strength training exercises from a standing position with progressive resistance, to simulate real-world, everyday activities at home, outdoors or on the playing field. Said exercises can be performed with the use of one arm, or two arms utilizing several hand grip options (supine, pronated, neutral and alternate), with the use of one or two legs, and/or with a combination of various arm and leg movements.

With the box training apparatus of the present invention, a user can exercise the whole body, utilizing at least three (3) planes of body movement:

SAGITTAL: moving the body vertically forward and backward;

FRONTAL: moving the body vertically from side to side; and

TRANSVERSE: using the body horizontally with rotation.

A user can also train for increased stabilization, used to describe a stationary position while exerting or resisting external force.

The box training apparatus trains a user's core in all planes of motion. The core helps stabilize a user's trunk, while performing "real-world" activities at home, work, outdoors or on the playing field. The core includes the deep muscles of the abdomen, hips and lower back to provide a solid base for effective exercise movement. Core based movements involve flexion and extension in the sagittal plane of movement, side flexion in the frontal plane, rotation in the transverse plane and isometric muscle contraction to achieve stabilization.

A user can perform a variety of exercises using one joint, as with an isolation movement; multi-joints with compound movements, and several body parts with a sequence of movement patterns referred to as "complex movements". The box training apparatus systematically trains a user's body kinetic chain: a sequence of linked movements working together to produce more efficient transfer of strength through the body, when performing a physical task, for example lifting a box. Movement produced at any joint in the kinetic chain directly affects the joints above and below it. The training apparatus allows for training the body as a whole with integrated exercise (movement) progressions.

The present invention can also be used by multiple individuals in a group setting, such as, for example, in an exercise class, in a fitness center, or any other group setting. When the apparatus is used in a group exercise class, an instructor of the group exercise class can be beneficially certified in training with said box training apparatus. A certified instructor of a group exercise class can lead a series of exercises using the box training apparatus in order to provide the class participants with a complete body workout. Said instructors can employ various exercise movements and movement patterns, based on program goals—whether emphasis is placed on a particular group of muscles, or whether the focus is on balance, and better exercise technique. As a result, use of the box training apparatus of the present invention increases a user's range of motion and stability in exercise performance, improves a user's functional strength, and corrects muscle weakness that can inhibit a user's performance of a physical movement.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
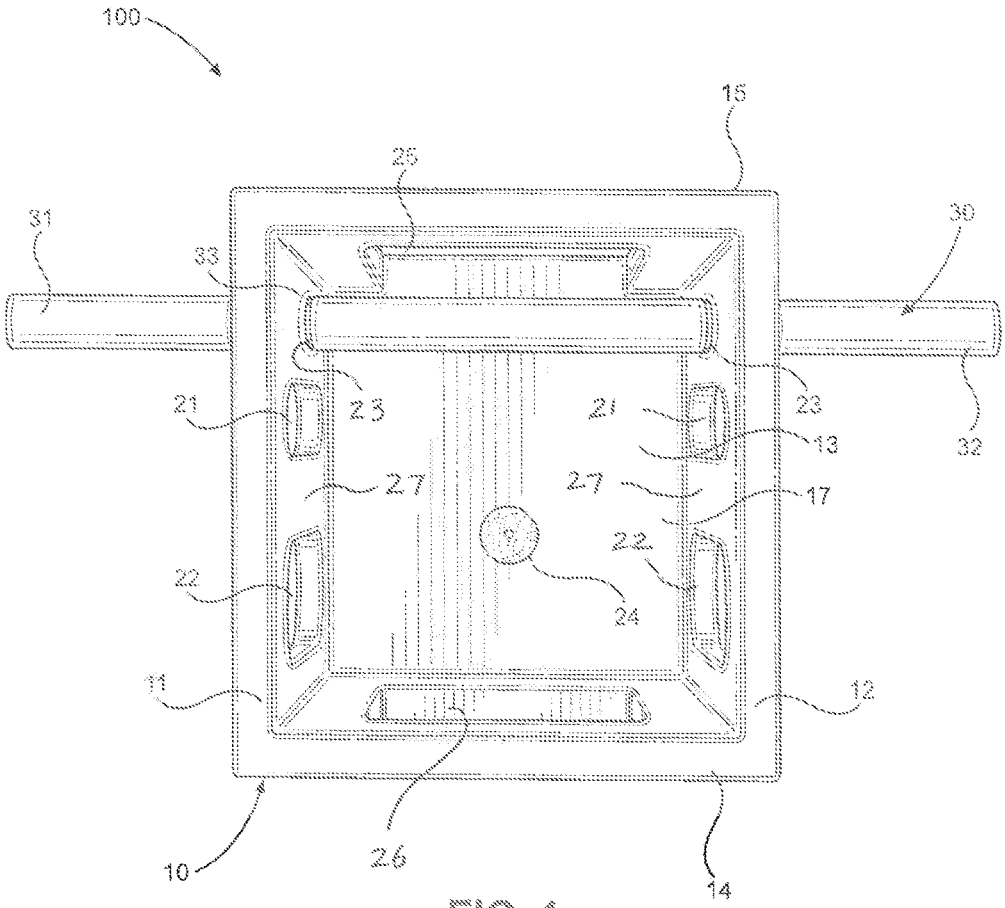
FIG. 1 depicts a front view of a preferred embodiment of a box training apparatus of the present invention with a short dowel member received within aligned circular apertures.

Referring to the drawings, FIG. 1 depicts an end view of a box training assembly 100 of the present invention generally comprising box member 10. Box training assembly 100 of the present invention can be manufactured in a variety of different dimensions; in a preferred embodiment, said box training assembly 100 has dimensions that are relatively wide enough to provide stability and safety to an average human body while permitting ease of movement by a user. Further, box training assembly 100 of the present invention can be manufactured from a rigid structural material, such as, for example, wood, metal and/or molded polymer, or any other substantially rigid material exhibiting desired strength characteristics.

In a preferred embodiment, box member 10 of box training assembly 100 comprises a plurality of substantially planar panels that are connected via bolt(s) 19, fasteners, adhesive or other attachment means. Still referring to FIG. 1, box member 10 generally comprises substantially planar side members 14 and 15, planar side members 11 and 12, and back member 13. Side members 14 and 15 are hereinafter referred to as "base" member 14 and "top" member 15 for ease of reference, although it is to be observed that any one of side members 11, 12, 14, or 15, as well as back member 13, can be used as a base or foundation to rest box training assembly 100 on an underlying surface depending on the particular orientation of box member 10.

Said side members 11 and 12 are oriented in a substantially parallel configuration relative to each other, while base member 14 and top member 15 are oriented in a substantially parallel configuration relative to each other. Back member 13 is oriented in a substantially perpendicular configuration to said side members 11 and 12, base member 14 and top member 15. Said base 14, top 15, sides 11 and 12, and back member 13 cooperate to form or define an inner space or chamber 17 for receiving a plurality of weights or any other additional weight sources. Additionally, although not depicted in FIG. 1, chamber 17 of box member 10 can also be used to store any other additional sources of weight or resistance.

In a preferred embodiment, first and second side members 11 and 12 each comprise a plurality of shaped apertures, wherein said apertures can be arranged in a variety of different configurations (such as, for example, an elongate shape or a circular shape). Said apertures form shaped portions of said side members 11 and 12 that form handles or grip members, therefore allowing a user to be able to hold box training assembly 100 of the present invention in a variety of different positions and using a variety of different hand grips.

For example, still referring to FIG. 1, in a preferred embodiment, first and second side members 11 and 12 each have a plurality of elongate slots or apertures—a first aperture 21 and a second aperture 22. First side member 11 comprises first elongate aperture 21 that is relatively smaller than second elongate aperture 22, wherein said apertures 21 and 22 cooperate to define cross grip member 27 there between. Said first aperture 21, second aperture 22 and cross grip member 27 allow a user's thumb and/or fingers to fit comfortably into apertures 21 and/or 22, such as when gripping cross member 27 or other surface of said first side member 11. With such a grip, a user's wrist is in a substantially straight line with respect to said user's forearm, particularly when dowel 30 is removed, and/or when box member 10 is reoriented 180 degrees from the depiction in FIG. 1 (that is, with box member 10 rotated so that the positions of base member 14 and top member 15 are switched).

Still referring to FIG. 1, second side member 12 comprises first elongate aperture 21 that is relatively smaller than second elongate aperture 22, wherein said apertures 21 and 22 cooperate to define cross grip member 27 there between. Said first aperture 21, second aperture 22 and cross grip member 27 allow a user's thumb and/or fingers to fit comfortably into apertures 21 and/or 22, such as when gripping cross member 27 or other surface of said second side member 12. With such a grip, a user's wrist is in a substantially straight line with respect to said user's forearm.

In a preferred embodiment, aperture 21 of first side member 11 is generally aligned with aperture 21 of second side member 12, while aperture 22 of first side member 11 is generally aligned with aperture 22 of second side member 12. Thus, first and second elongate apertures 21 and 22 and/or cross member 27 on first side member 11, and first and second elongate apertures 21 and 22 and/or cross member 27 on second side member 12, allow a user to hold box training member 10 of the present invention in a neutral grip hand position, wherein a user's palms are facing each other during exercise performance. Thus, a neutral grip hand position can provide safety, efficiency, and exercise versatility to said user during an exercise movement.

Further, in a preferred embodiment, first side member 11 and second side member 12 each have at least one substantially circular aperture 23 extending there through. Circular apertures 23 of said first side member 11 and second side member 12 are aligned to allow for a dowel member (described below) to be slidably received through said aligned apertures 23 and extend between said first side member 11 and second side member 12. In such a configuration, said dowel serves as an additional hand gripping surface for box training assembly 100 of the present invention.

Additionally, in a preferred embodiment, circular apertures 23 are positioned off center—that is between the mid-point of said first and second side members 11 and 12, and back member 13—thereby allowing a user to hold box training assembly 100 of the present invention (when a dowel is inserted) closer to his or her body, thus mimicking a more natural, anatomically beneficial standing position for a human body.

In a preferred embodiment, top member 15 comprises a substantially square-shaped opening 25 extending through said top member 15. Opening 25 allows a user to be able to reach his or her hand through top member 15 of box member 10 into chamber 17. Additionally, opening 25 allows a user to be able to easily switch box member 10 from one hand to another hand by allowing both hands to fit into opening 25 simultaneously during the exchange. In this manner, a user can grasp a dowel member, such as first dowel member 30, and ultimately, box member 10. As a result, top member 15 with opening 25 provides a user an additional means of grasping box training assembly 100 of the present invention, and is used to provide a secure hand grip in order for a user to perform alternate exercise movements when using one box member 10 per hand, thus providing for a variety of additional exercise movements.

Moreover, in a preferred embodiment, base member 14 comprises a substantially rectangular-shaped opening or aperture 26 extending through said base member 14. Opening 26 allows a user's thumb and/or fingers to fit comfortably through base member 14 into chamber 17, and thus grip any surface of said base member 14. With such a grip, a user's wrist is in a substantially straight line with respect to said user's forearm. Opening 25 located on side member 15, lines up with a narrower (rectangular) opening 26, located on side member 14. When box member 10 is resting (positioned) on back member 13, apertures 25 and 26 allow the user to grip the box member 10 (that is, portions of side members 14 and 15) using a neutral "grip", (palms of hands facing each other to perform a variety of exercise movements.

When box member 10 is resting on back member 13, the weight plates are positioned vertically on the rigid rod member 24. The weight plates can be changed easily because the box has an open face. When said box member 10 is resting on its back member 13, the position of the rigid rod member 24, enables a user to perform a variety of exercises; to strengthen the body to lift objects that have an uneven (i.e., not centered) weight distribution. This offset weight distribution trains a user's body to increase functional strength for real-life situations.

Rigid rod member 24 is positioned "off-center" on back member 13; said rigid rod member 24 is positioned closer to side member 14 than side member 15. When box member 10 is resting on back member 13, a user can place parts of the user's hands into apertures 25 and 26 in order to grip box member 10 by portions of side members 14 and 15 (said sides, in cooperation with said apertures, essentially forming hand grips), in order to lift box member 10 and perform a variety of exercises. Because rigid rod member 24 is off-center; more weight must be lifted with the hand representing the side of the body that is grasping a part of side 14 through aperture 26. As such, there is uneven stress placed on the body. In order for the body to lift the "uneven" weight "evenly" the core and stabilizers of the hips, gluteal muscles and spine must align themselves to maintain a correct posture when lifting a weight that is unevenly distributed. This creates dynamic strength that can improve functional strength in real-life settings, outside a gym.

As depicted in FIG. 1, box member 10 generally comprises rod or post member 24 that is attachably mounted to back member 13 of box member 10 via a threaded bolt 18, or any other secure attachment means. Rod member 24 comprises a substantially cylindrical shape and is manufactured from a relatively rigid material, such as, for example, metal, composite or any other material exhibiting desired strength and rigidity characteristics. Further, rod member 24 beneficially provides for a means for permitting a user to add at least one weight plate(s) for a variety of strength levels, thereby allowing for a system of progressive variation (increase or decrease) in weight resistance. In a preferred embodiment, said rod member 24 is offset and positioned substantially equidistant between first and second side members 11 and 12, but closer to base member 14 than top member 15. Put another way, rod member 24 is positioned along the centerline between first and second side members 11 and 12, but between the midpoint of back member 13 and base member 14 (that is, closer to base member 14 than top member 15).

When box member 10 is oriented to be resting on side member 14, said rod member 24 is balanced and positioned substantially equidistant between first and second side members 11 and 12. Any weight being lifted is balanced. When said box member 10 is resting on side member 15, said rod member is balanced and positioned substantially equidistant between side members 11 and 12, the weight being lifted is balanced. When box member 10 is resting on back 13, said rod member 24 is off-balance (not centered); said rod member 24 is positioned closer to side member 14 than side member 15. In this configuration, weight being lifted is off-balance, with more weight closer to side member 14 and less weight (resistance) closer to side member 15.

In a preferred embodiment, box training assembly 100 of the present invention comprises at least a first dowel member 30. First dowel member 30 comprises a substantially cylindrical shape and is used to provide a secure hand grip in order for a user to perform alternate exercise movements when using only one box member 10. First dowel member 30 can also be used to enable box training assembly 100 to rotate or swivel from front to back (back and forth) during certain other exercise movements, thereby providing a dynamic motion to an exercise movement that activates a user's smaller assisting muscles (synergists) and stabilizer muscles that help a user's main muscle (or primary mover) that is performing work.

Further, in a preferred embodiment, first dowel member 30 comprises at least one groove 33 that is located at or near each end, 31 and 32, of first dowel member 30. Groove 33 has a relatively smaller diameter than first dowel member 30, thereby allowing groove 33 to sit within circular apertures 23 of first and second side members 11 and 12 of box training assembly 100, and thus, prevent first dowel member 30 from sliding axially through aligned apertures 23 of box training assembly 100 during exercise performance.

In a preferred embodiment, when a user is performing an exercise with first dowel 30 inserted within box member 10, the design of the box training apparatus 100 enables a user to be able to remove or add a weight plate (or any other additional source of resistance) to rod member 24 by way of inner chamber 17 of box member 10. Thus, first dowel 30 does not have to be removed from box member 10 when changing the level of resistance. As a result, this saves a user time during exercise performance and increases ease of use.

Figure 2:
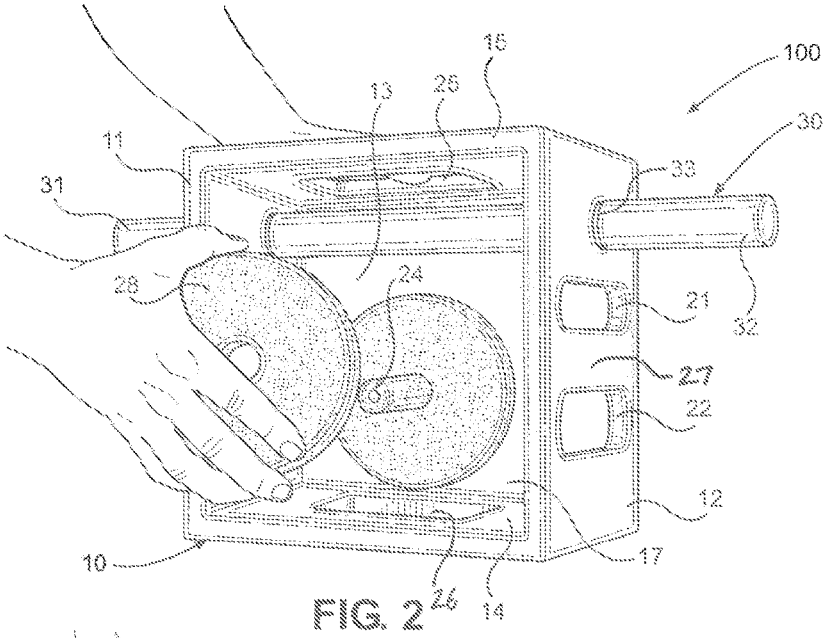
FIG. 2 depicts a front perspective view of a preferred embodiment of a box training apparatus of the present invention with a short dowel member received within aligned circular apertures and at least one weight plate being installed and received on a solid rod member.

FIG. 2 depicts a perspective view of at least one weight plate 28 being received within chamber 17 of box training assembly 100 of the present invention. Box member 10 comprises first side member 11 and second side member 12, and back member 13 connected to top member 15 and base member 14, thereby cooperating to form inner chamber 17. First side member 11 and second side member 12 each have aligned hole apertures 23, as well as first elongate apertures or slots 21 and second elongate apertures or slots 22. Said apertures 21 and 22, and cross members 27, can be used to permit a variety of different hand grips for a user (typically, when box member 10.

Rigid rod member 24 extends in a relatively perpendicular direction from back member 13 into chamber 17. Rigid rod member 24 enables a user to add at least one weight plate(s) 28 for a variety of strength levels, thereby allowing for a system of progressive adjustment in weight resistance. As illustrated in FIG. 2, in a preferred embodiment, a user can easily and efficiently add one or more weight plates 28 onto rigid rod member 24 within opening 17 of box member 10, even when short dowel member 30 is already positioned into place (i.e., received within aligned apertures 23).

Figure 3:
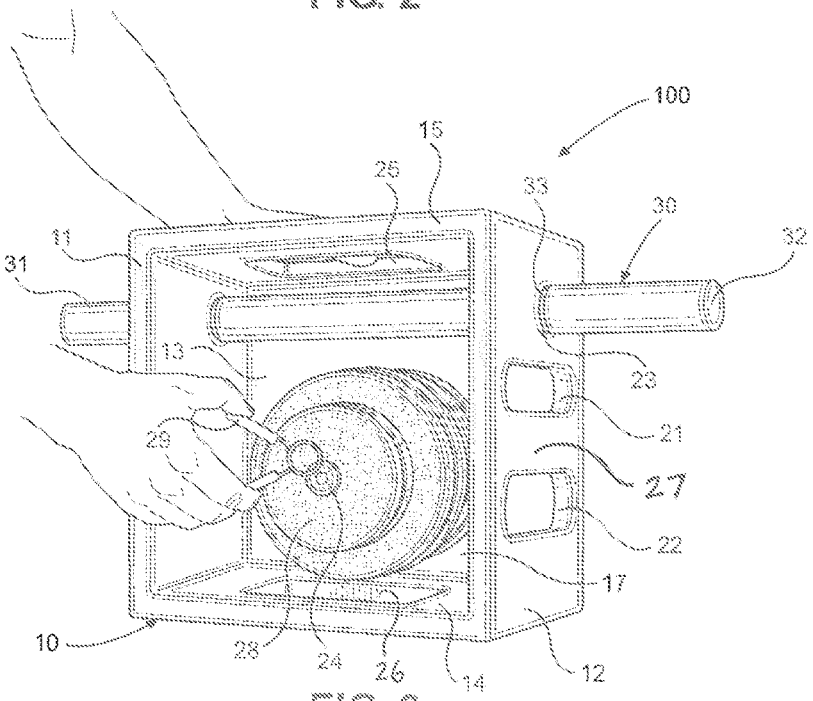
FIG. 3 depicts a front perspective view of a preferred embodiment of a box training apparatus of the present invention with a short dowel member received within aligned circular bores and a clamp being installed to secure weight plates on a solid rod member within said box training apparatus.

FIG. 3 depicts a perspective view of a clamp member 29 being received within chamber 17 of box member 10 and positioned on rod member 24 of box training assembly 100 of the present invention. In a preferred embodiment, clamp member 29 can be used to secure and hold at least one weight plate(s) 28 in place, while said weight plate 28 is located within chamber 17 of box member 10 of the present invention. Clamp member 29 is slidably placed over rod member 24 and locked in place, thereby beneficially holding weight plate 28 in place within box member 10 while a user is performing an exercise movement.

Figure 4:
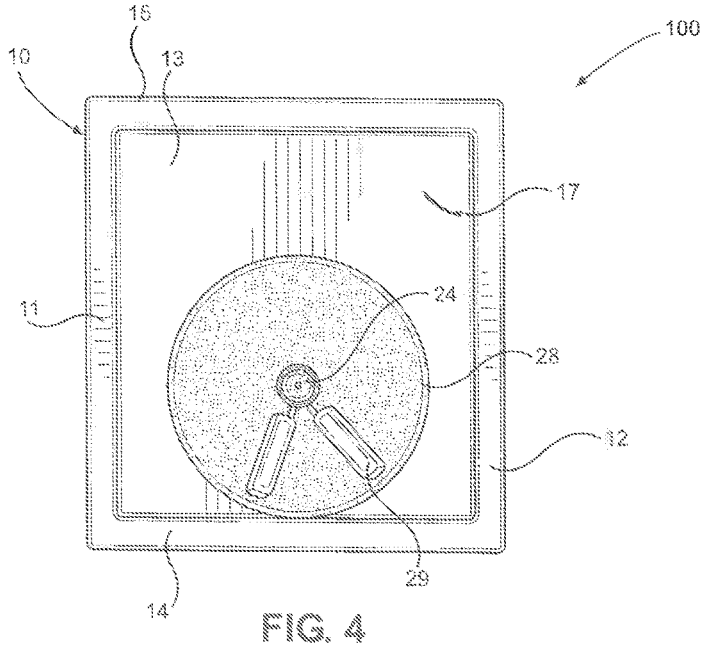
FIG. 4 depicts a front view of a preferred embodiment of a box training apparatus of the present invention with at least one weight plate and a clamp positioned on a solid rod member within said box training apparatus.

FIG. 4 depicts an end view of box training system assembly 100 of the present invention comprising at least one weight plate 28 and clamp member 29. Box member 10 comprises first side member 11 and second side member 12, as well as back member 13, connected to top member 15 and base member 14, thereby cooperating to form chamber 17. Rigid rod member 24 extends outwardly in a perpendicular direction from back member 13 into chamber 17. Weight plate 28 is inserted into chamber 17 and received on rod member 24, wherein clamp 29 beneficially secures weight plate 28 on said rod member 24.

Figure 5:
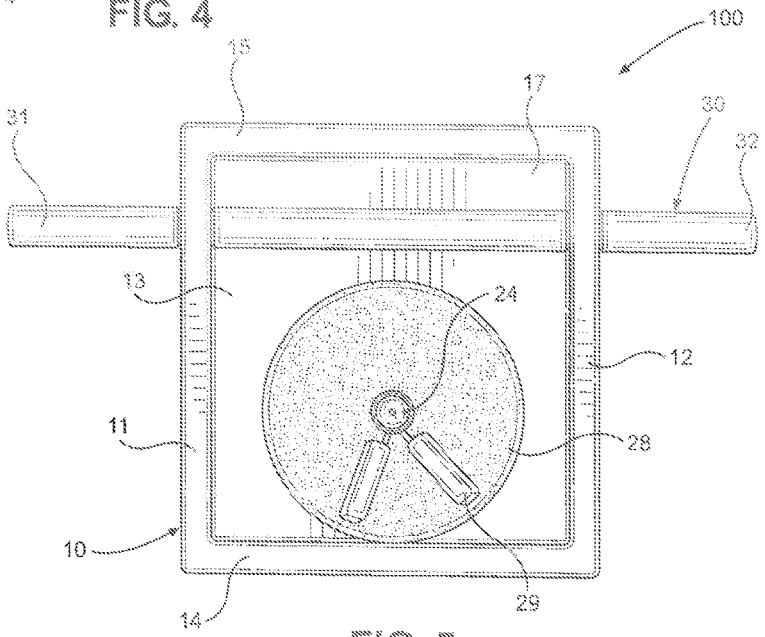
FIG. 5 depicts a front view of a preferred embodiment of a box training system apparatus of the present invention with a short dowel member received within aligned circular apertures and at least one weight plate and a clamp positioned on a solid rod member within said box training system apparatus.

FIG. 5 depicts an end view of box training assembly 100 of the present invention comprising at least one weight plate 28, clamp member 29, and first dowel member 30. Box member 10 comprises first side member 11 and second side member 12 attachably connected to top member 15, base member 14 and back member 13, thereby cooperating to form or define inner chamber 17. Rigid rod member 24 extends in a relatively perpendicular direction from back member 13 into said chamber 17. Weight plate 28 is received on rod member 24 and secured in place using clamp member 29.

Still referring to FIG. 5, box training assembly 100 comprises first dowel member 30. First dowel member 30 comprises a substantially cylindrical shape and is used to provide a secure hand grip in order for a user to perform alternate exercise movements when using one box member 10 per hand. First dowel member 30 comprises a recessed groove 33 at or near first end 31 and second end 32 of first dowel member 30, wherein groove 33 has a relatively smaller diameter than first dowel member 30. First dowel member 30 is received within aligned apertures 23 on first side member 11 and second side member 12 of box member 10, thereby allowing groove 33 to sit within circular aperture 23 on first side member 11 and second side member 12 of box 10 and thus, prevent first dowel member 30 from axially sliding through box 10, particularly during exercise performance.

Figure 6:
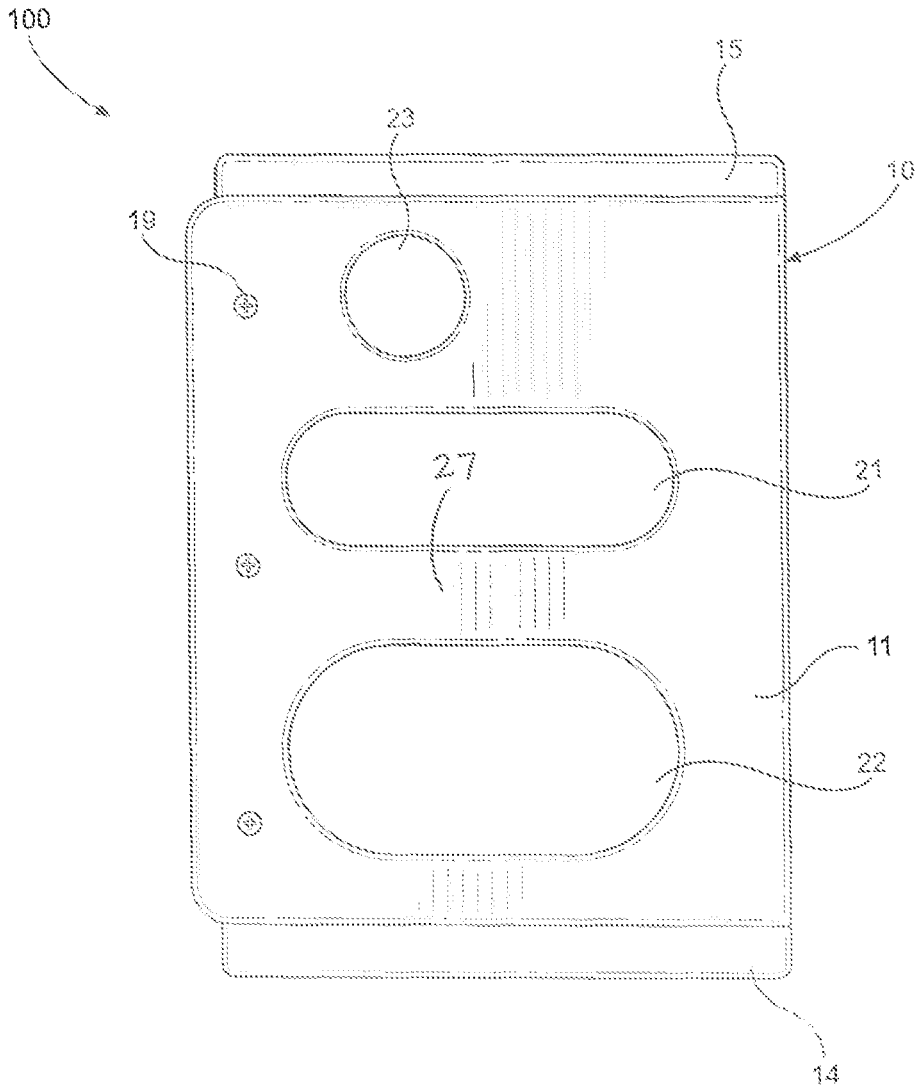
FIG. 6 depicts a side view of a preferred embodiment of a box training apparatus of the present invention.

FIG. 6 depicts a side view of box training assembly 100 of the present invention generally comprising first side member 11. First side member 11 is attachably connected to back member 13 via bolt(s) 19, or other fastener or attachment means, wherein first side member 11 and back member 13 are oriented in a substantially perpendicular configuration relative to each other. Further, first side member 11 comprises circular aperture 23, first aperture 21 and second aperture 22; said first aperture 21 and second aperture 22 cooperate to define cross grip member 27.

Although not depicted in FIG. 6, circular aperture 23 is designed and positioned to allow a dowel member to be slidably received through circular aperture 23, thereby creating an additional means to grasp box training assembly 100 for a particular exercise movement. Additionally, in a preferred embodiment, circular apertures 23 are positioned off center—that is between the mid-point of said first and second side members 11 and 12, and back member 13—thereby allowing a user to hold box training assembly 100 of the present invention (when a dowel is inserted) closer to his or her body, thus mimicking a more natural, anatomically beneficial standing position for a human body.

Still referring to FIG. 6, first side member 11 comprises first elongate aperture 21 that is relatively smaller than second elongate aperture 22, thereby allowing a user's fingers to fit comfortably into a space of the relatively smaller elongate aperture 21. Additionally, first side member 11 comprises second elongate aperture 22 that is relatively larger than first elongate aperture 21, thereby allowing a user's thumb and palm to fit comfortably into a space of the relatively larger elongate aperture 22 in order for a user's wrist to be in a substantially straight line alignment with respect to said user's forearm. Although not visible in FIG. 6, it is to be observed that second side member 12 can comprise a substantially identical configuration as first side member 11—having circular aperture 23, first elongate aperture 21, and second aperture 22—thereby providing a mirror image of first side member 11 and aperture(s)/slot(s) thereof.

Figure 7:
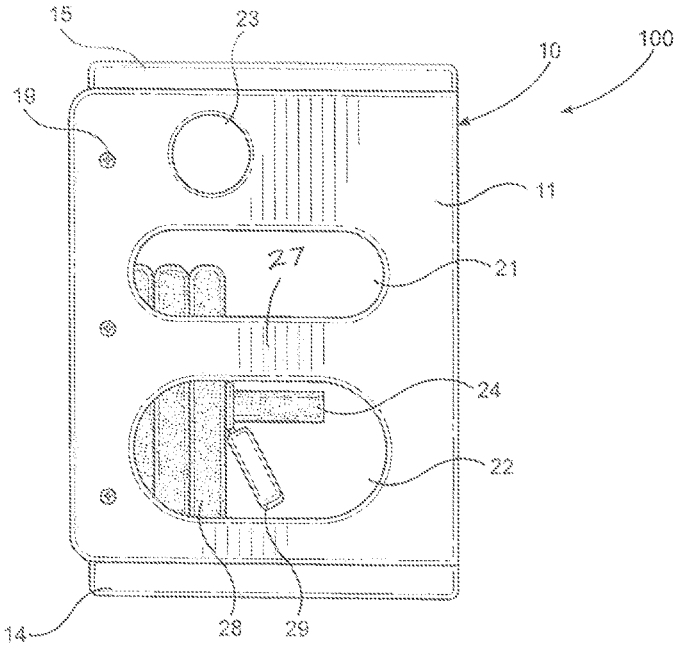
FIG. 7 depicts a side view of a preferred embodiment of a box training apparatus of the present invention with multiple weight plates and a clamp positioned on a solid rod member within said box training apparatus.

FIG. 7 depicts a side view of box training assembly 100 of the present invention comprising at least one weight plate(s) 28 and clamp member 29 received within chamber 17 of box member 10. First side member 11 is attachably connected to back member 13 and has circular aperture 23, first elongate aperture 21, and second elongate aperture 22;

said first aperture 21 and second aperture 22 cooperate to define cross grip member 27. Rigid rod member 24 extends in a substantially perpendicular direction from back member 13 into chamber 17. Weight plate 28 is positioned within chamber 17 and received on rod member 24, wherein clamp 29 beneficially secures weight plate 28 in place on said rod member 24.

Although not visible in FIG. 7, it is to be observed that second side member 12 comprises a substantially similar configuration as first side member 11—having circular aperture 23, first elongate aperture 21, and second elongate aperture 22, thereby providing a mirror image of first side member 11 and aperture(s)/slot(s) thereof.

Figure 8:
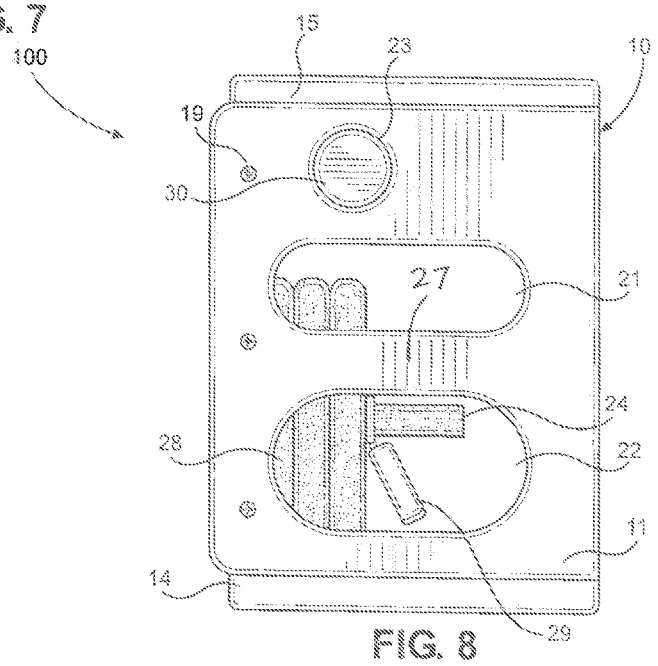
FIG. 8 depicts a side view of a preferred embodiment of a box training system apparatus of the present invention with a short dowel member received within aligned circular apertures and multiple weight plates and a clamp positioned on a solid rod member within said box training apparatus.

FIG. 8 depicts a side view of box training assembly 100 of the present invention comprising first dowel member 30 and at least one weight plate(s) 28 and clamp member 29 received within box member 10. First side member 11 is connected to back member 13 and includes circular aperture 23, first elongate aperture 21, and second elongate aperture 22; said first aperture 21 and second aperture 22 cooperate to define cross grip member 27. Rigid rod member 24 extends in a substantially perpendicular direction from back member 13 into chamber 17. Weight plate 28 is received on rod member 24, and clamp 29 beneficially secures weight plate 28 in place on said rod member 24.

Still referring to FIG. 8, first dowel member 30 is received within aligned apertures 23 of first side member 11 and second side member 12 of box member 10, thereby allowing recessed groove 33 to sit within circular apertures 23 on first side member 11 and second side member 12 of box member 10, (although not depicted in FIG. 8) and, thus, prevent first dowel member 30 from axially sliding through box member 10, particularly during exercise performance.

Figure 9:
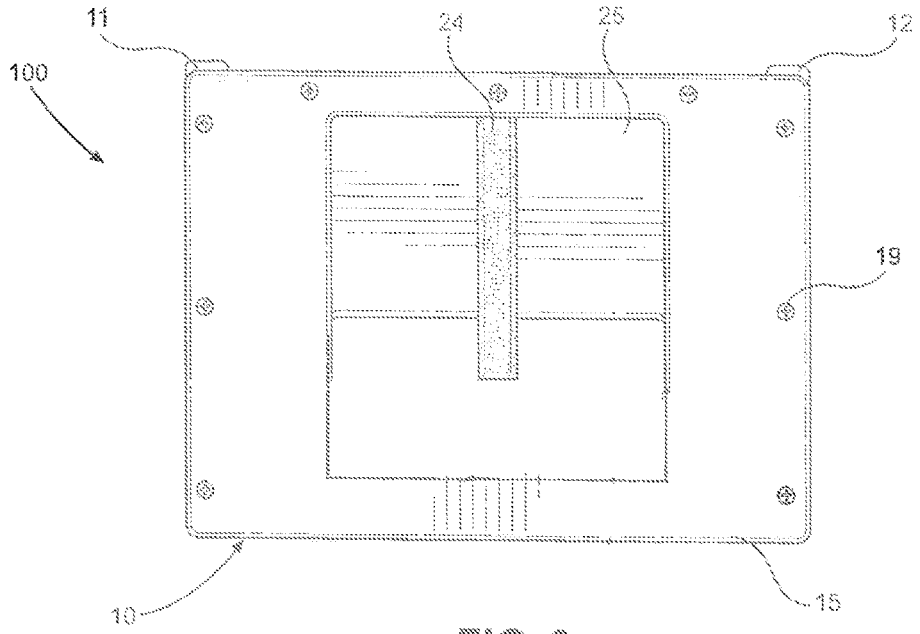
FIG. 9 depicts a top view of a preferred embodiment of a box training apparatus of the present invention.

FIG. 9 depicts a top view of box training assembly 100 of the present invention generally comprising top member 15 of box member 10. Top member 15 is connected to first side member 11 and second side member 12 and back member 13 via bolts 19, fasteners, or other attachment means, and includes a relatively square-shaped opening 25 extending through said top member 15. Opening 25 allows a user to be able to reach his or her hand through top member 15 of box member 10 into chamber 17. Additionally, opening 25 allows a user to be able to easily switch box member 10 from one hand to another hand by allowing both hands to fit into opening 25 simultaneously during the exchange. In this manner, a user can grasp a dowel member such as first dowel member 30 (although not illustrated in FIG. 9), and ultimately, box member 10. As a result, top member 15 with opening 25 provides a user an additional means of grasping box training assembly 100 of the present invention, and is used to provide a secure hand grip in order for a user to perform alternate exercise movements when using one box member 10 per hand, thus providing for a variety of additional exercise movements.

Figure 10:
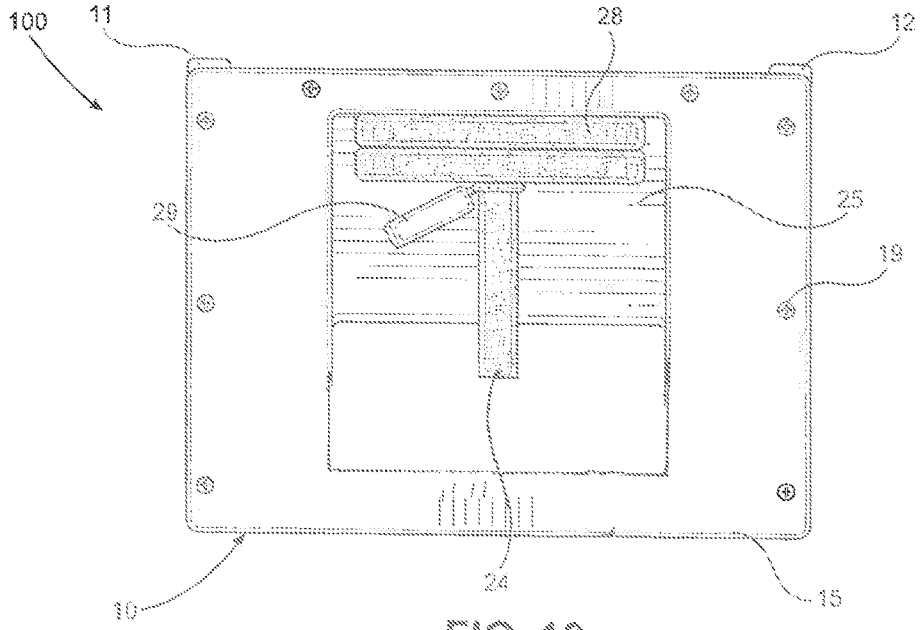
FIG. 10 depicts a top view of a preferred embodiment of a box training apparatus of the present invention with multiple weight plates and a clamp positioned on a solid rod member within said box training apparatus.

FIG. 10 depicts top view of box training assembly 100 of the present invention comprising at least one weight plate(s) 28 and clamp member 29 received within box member 10. Top member 15 is attachably connected to first side member 11, second side member 12 and back member 13 via bolts 19, or other fasteners, and includes a relatively square-shaped opening 25. Rigid rod member 24 extends in a substantially perpendicular direction from back member 13 into chamber 17 of box member 10. Weight plate 28 is received on rod member 24 and secured in place using clamp 29.

Figure 11:
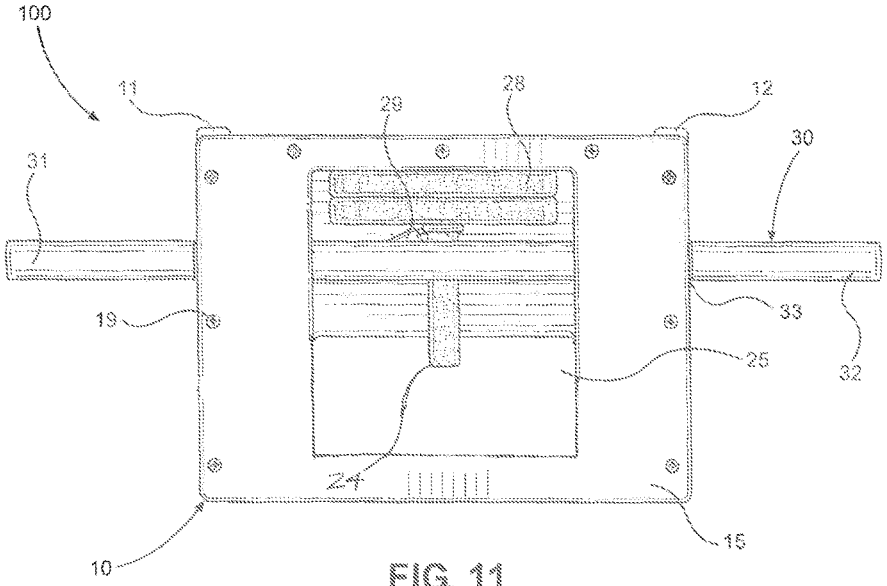
FIG. 11 depicts a top view of a preferred embodiment of a box training apparatus of the present invention with a short dowel member received within aligned circular slots and multiple weight plates and a clamp positioned on a solid rod member within the present invention.

FIG. 11 depicts top view of box training assembly 100 of the present invention comprising first dowel member 30 and at least one weight plate(s) 28 and clamp member 29 received within chamber 17 of box member 10. Top member 15 has opening 25, wherein opening 25 allows a user to reach into and grasp items in chamber 17, such as first dowel member 30, thereby providing a secure hand grip in order for a user to perform alternate exercise movements when using one box member 10 per hand. Still referring to FIG. 11, rod member 24 extends in a substantially perpendicular direction from back member 13 into chamber 17 of box member 10. Weight plate 28 is received on rod member 24 and clamp 29 beneficially secures weight plate 28 on rod 24.

Figure 12:
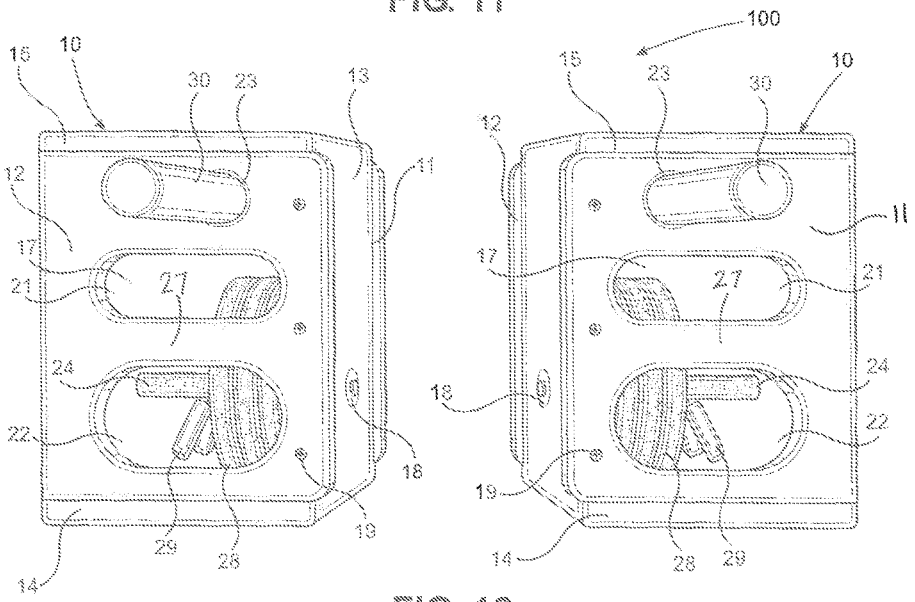
FIG. 12 depicts a side view of two box training members, each having a short dowel member received within aligned circular apertures and multiple weight plates and a clamp positioned on a solid rod member within each of said box members.

FIG. 12 depicts a perspective view of two box training assemblies 100, each comprising a first dowel member 30 received within aligned circular apertures 23 on first side member 11 and second side member 12, and weight plates 28 and clamp 29 are received on each rod member 24 within each chamber 17. Additionally, first side member 11 and second side member 12 each have first elongate aperture 21 and second elongate aperture 22, wherein said apertures 21 and 22 cooperate to define cross grip members 27 there between.

Figure 13:
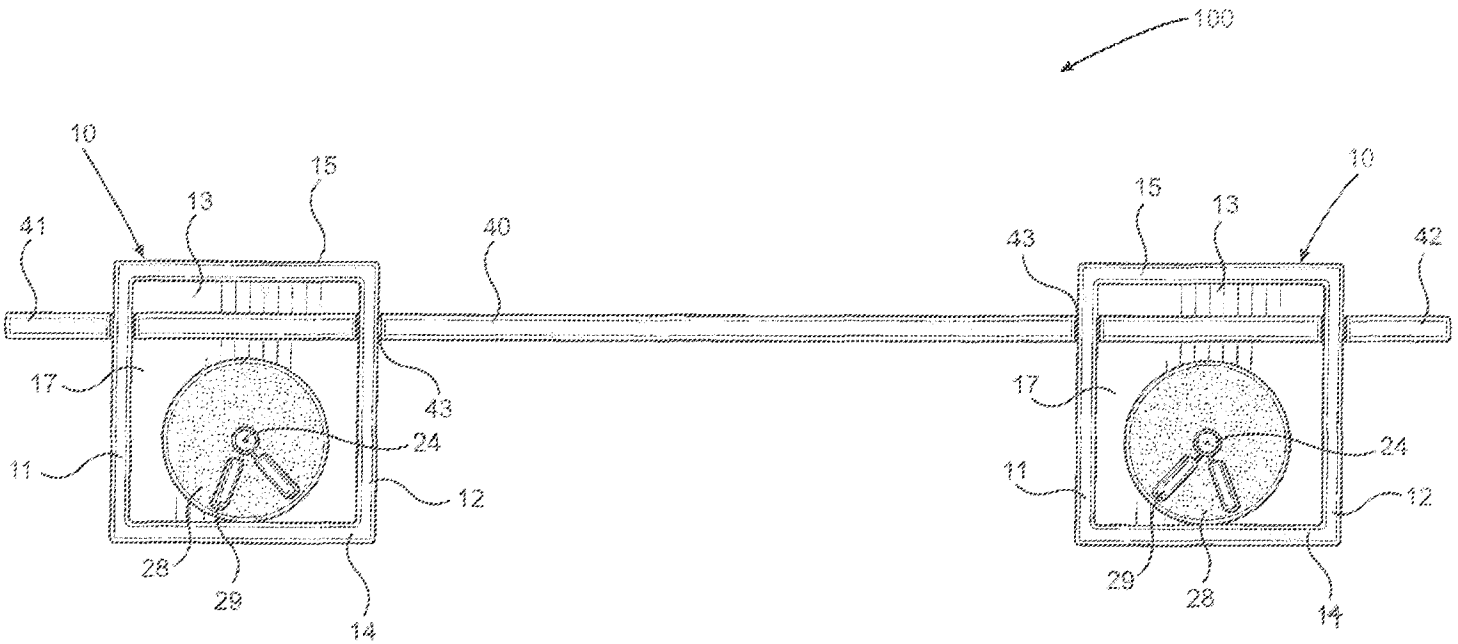
FIG. 13 depicts a front view of two box training members attachably connected by a long dowel member, with each box member having multiple weight plates and a clamp positioned on a solid rod member within each box member.

FIG. 13 depicts an end view of two box training assemblies 100 attachably connected by a second dowel member 40. Each box assembly 100 further comprises at least one weight plate(s) 28 and clamp 29 positioned on each rod member 24 within each chamber 17. Each box member 10 comprises first side member 11 and second side member 12, and back member 13 attachably connected to top member 15 and base member 14, thereby cooperating to form chamber 17. Rod member 24 extends in a substantially perpendicular direction from back member 13 into chamber 17.

As depicted in FIG. 13, box training assembly 100 comprises second dowel member 40. Second dowel member 40 comprises a substantially cylindrical shape and is used to connect two box members 10 in order to provide an alternate method of exercise training. Thus, second dowel member 40 is used to provide a secure hand grip in order for a user to perform a variety of exercise movements when multiple box training systems are connected.

In a preferred embodiment, second dowel member 40 includes recessed groove 43 at or near each end, 41 and 42, of second dowel member 40, wherein groove 43 has a relatively smaller diameter than second dowel member 40. Second dowel member 40 is received within aligned circular apertures 23 on first side member 11 and second side member 12 of box member 10, thereby allowing groove 43 to sit within said circular apertures 23 on first and second side members 11 and 12 of box member 10 and, thus, prevent second dowel member 40 from sliding axially through aligned apertures 23 of box member 10 during exercise performance.

In a preferred embodiment, when a user is performing an exercise with second dowel member 40 inserted within box member 10, the design of the box training apparatus 100 enables a user to be able to remove or add a weight plate(s) 28 (or any other additional source of resistance) to rod member 24 by way of inner chamber 17 of box member 10. Thus, second dowel 40 does not have to be removed from box member 10 when changing a desired level of resistance. As a result, this saves a user time during exercise performance and increases ease of use.

Figure 14:
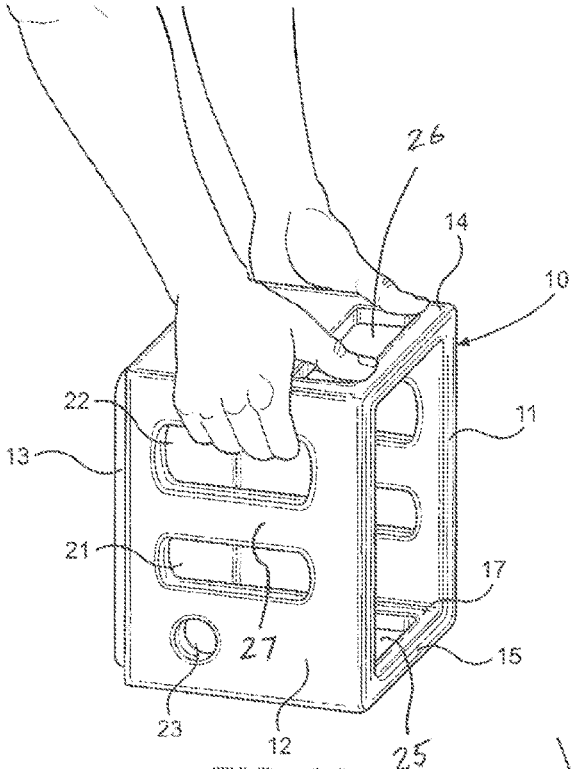
FIG. 14 depicts a side perspective view of a neutral hand grip position of a box training apparatus of the present invention.

FIG. 14 depicts a perspective view of a neutral hand grip position of box training assembly 100 of the present invention. First side member 11 and second side member 12 each have a plurality of apertures, wherein said apertures comprise a variety of different configurations (such as, for example, a relatively elongate shape or a relatively circular shape) that allow a user to be able to grip and securely hold said box member 10 in a variety of different positions and using different hand grips.

As illustrated in FIG. 14, first and second side members 11 and 12 each comprise a plurality of elongate slots or apertures—first elongate aperture 21 and second elongate aperture 22—that allow a user to be able to hold box member 10 in a variety of different positions and different hand grips. First side member 11 comprises first elongate aperture 21 that is relatively smaller than second elongate aperture 22, wherein said apertures 21 and 22 cooperate to define cross grip member 27 there between. Said first aperture 21, second aperture 22 and cross grip member 27 allow a user's thumb and/or fingers to fit comfortably into apertures 21 and/or 22, such as when gripping cross member 27 or other surface of said first side member 11. With such a grip, a user's wrist is in a substantially straight line with respect to said user's forearm.

Further, although not illustrated in FIG. 14, second elongate aperture 22 can also allow a user's thumb and palm to fit comfortably into a space of the relatively larger elongate aperture 22 in order for said user's wrist to be in a substantially straight line alignment with respect to said user's forearm and in order to give said user an alternate means of holding box member 10.

Further, second side member 12 also has first elongate aperture 21 that is relatively smaller than second elongate aperture 22, wherein said apertures 21 and 22 cooperate to define cross grip member 27 there between. Said first aperture 21, second aperture 22 and cross grip member 27 allow a user's thumbs and/or fingers to fit comfortably into apertures 21 and/or 22. Further, although not illustrated in FIG. 14, second elongate aperture 22 can also allow a user's thumb and palm to fit naturally into a space of the relatively larger elongate aperture 22 in order for said user's wrist to be in a substantially straight line with respect to said user's forearm and in order to give said user an alternate means of holding box member 10.

As such, aperture 21 of first side member 11 is generally aligned with aperture 21 of second side member 12, while aperture 22 of first side member 11 is generally aligned with aperture 22 of second side member 12. Thus, first and second elongate apertures 21 and 22 and/or cross member 27 on first side member 11, and first and second elongate apertures 21 and 22 and/or cross member 27 on second side members 12, allow for a user to hold said box training assembly 100 in a neutral grip hand position, thereby providing safety, efficiency, and exercise versatility to a user during an exercise movement.

Figure 15:
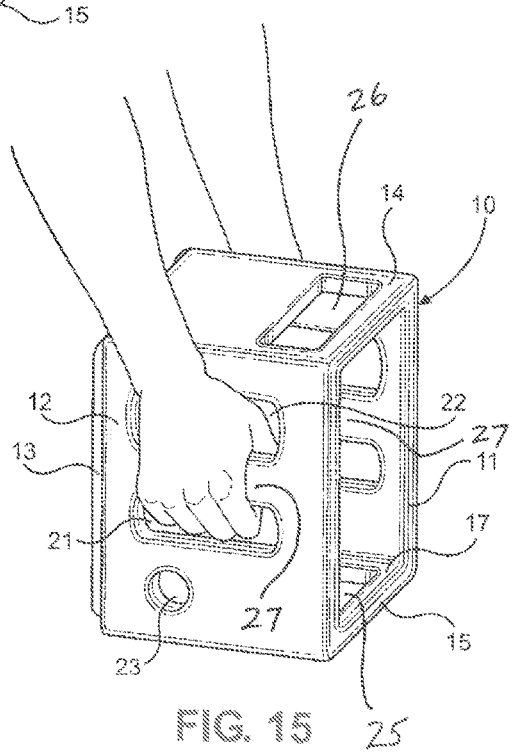
FIG. 15 depicts a side perspective view of an alternate neutral hand grip position of a box training apparatus of the present invention.

FIG. 15 depicts a perspective view of an alternate neutral hand grip position of box training assembly 100. First and second side members 11 and 12 each have a plurality of apertures, wherein said apertures comprise a variety of different configurations (such as, for example, a relatively elongate shape or a relatively circular shape) that allow a user to be able to hold said box training system apparatus of the present invention in a variety of different positions and using different hand grips.

As depicted in FIG. 15, first and second side members 11 and 12 each comprise first elongate aperture 21 and second elongate aperture 22, wherein apertures 21 and 22 cooperate to define cross grip member 27 there between. Said first aperture 21, second aperture 22, and cross grip member 27 allow a user to be able to hold box member 10 in a variety of different positions and using different hand grips. Thus, first side member 11 and second side member 12 each have first elongate aperture 21 that can allow a user's thumb and/or fingers to fit comfortably into a space of first elongate aperture 21. Additionally, first side member 11 and second side member 12 each have second elongate aperture 22 that can allow a user's thumb and/or palm to fit comfortably into a space of second elongate aperture 22 in order for a user's wrist to remain in a substantially straight alignment with respect to said user's forearm.

Figure 16:
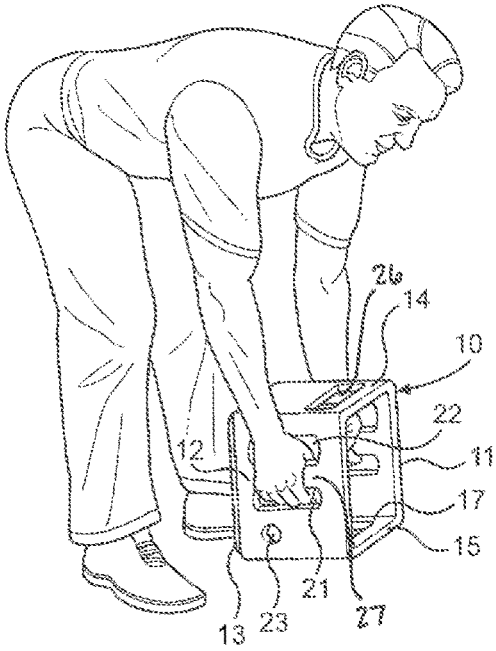
FIG. 16 depicts a side perspective view of a user holding a box training apparatus with an alternate neutral hand grip in a starting position of an exercise movement.
Figure 17:
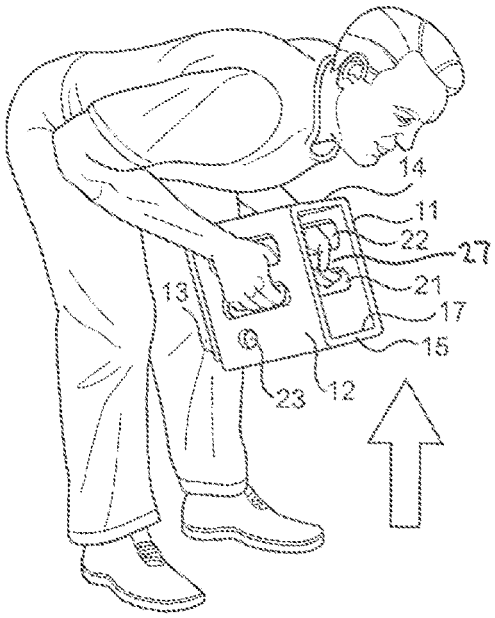
FIG. 17 depicts a side perspective view of a user holding a box training apparatus with an alternate neutral hand grip while performing an exercise movement.

FIG. 16 depicts a side perspective view of a user holding box training assembly 100 with an alternate neutral hand grip in a starting position of an exercise movement. As illustrated in FIG. 16, first elongate aperture 21 of first side member 11 and second side member 12 allows user's thumb and/or fingers to fit comfortably through opening of first aperture 21; second elongate aperture 22 of first side member 11 and second side member 12 allows user's thumb and/or palm to fit comfortably through opening of second aperture 22 in order for said user's wrist to be in a substantially straight alignment with respect to said user's forearm. Thus, first and second elongate apertures 21 and 22 on first and second side members 11 and 12, respectively, allow for a user to hold said box assembly 100 in an alternate neutral grip hand position, thereby providing safety, efficiency, and exercise versatility to said user during an exercise movement. FIG. 17 depicts a side perspective view of a user holding box training assembly 100 with an n alternate neutral hand grip while performing an exercise movement.

Figure 18:
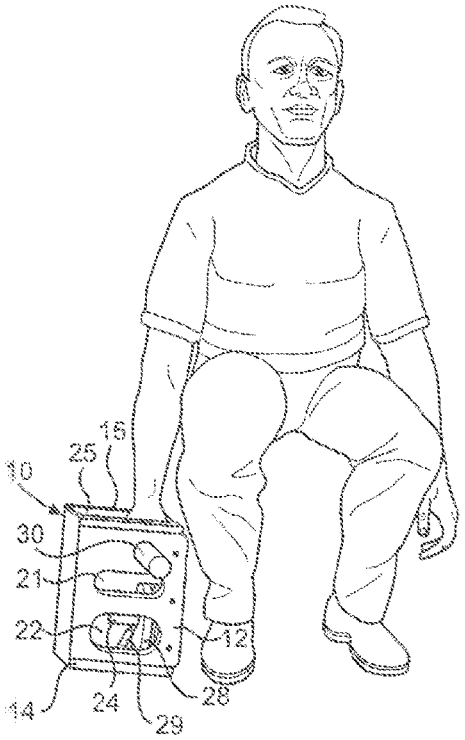
FIG. 18 depicts a front view of a user holding a box training apparatus by first dowel member in a starting position of an exercise movement.
Figure 19:
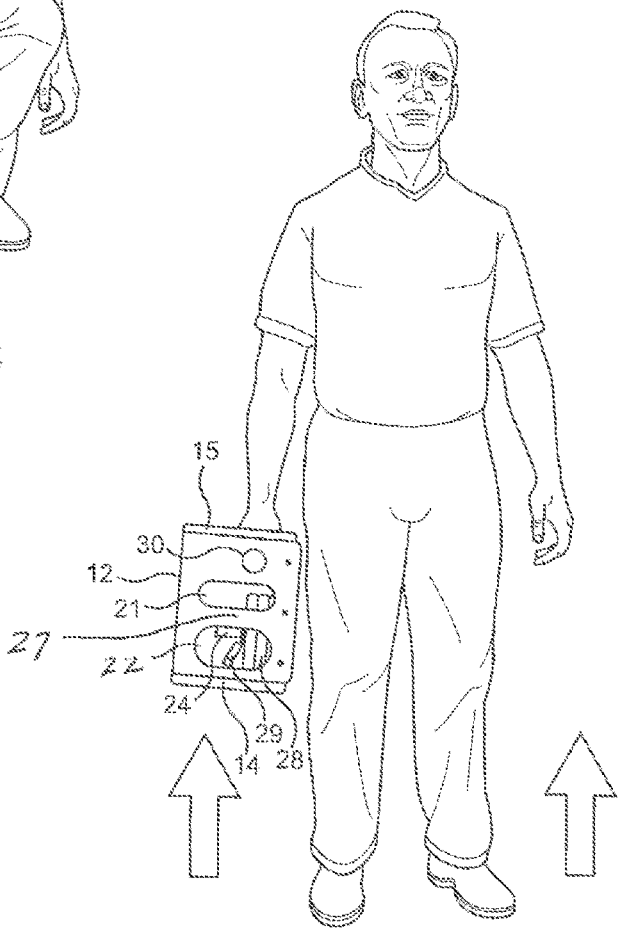
FIG. 19 depicts a front view of a user holding a box training apparatus by first dowel member while performing an exercise movement.

FIG. 18 depicts a front view of a user holding box training assembly 100 by first dowel member 30 in a starting position of an exercise movement. First and second side members 11 and 12 each comprise circular apertures 23, wherein circular apertures 23 are aligned to allow for first dowel member 30 to be slidably received through said aligned apertures 23. Further, top member 15 has opening 25, thereby allowing a user to be able to reach through opening 25 and grasp first dowel member 30, thus allowing dowel member 30 to be utilized as an additional hand grip for the box training assembly 100. Additionally, as depicted in FIG. 18, circular aperture 23 is positioned off center—that is, between the mid-point of said first and second side members 11 and 12, and back member 13—thereby allowing a user to hold box assembly 100 of the present invention relatively closer to his or her body, thus mimicking a more natural, anatomically advantageous standing position for a human body. FIG. 19 depicts a front view of a user holding box training assembly 100 by first dowel member 30 and performing an exercise movement.

Figure 20:
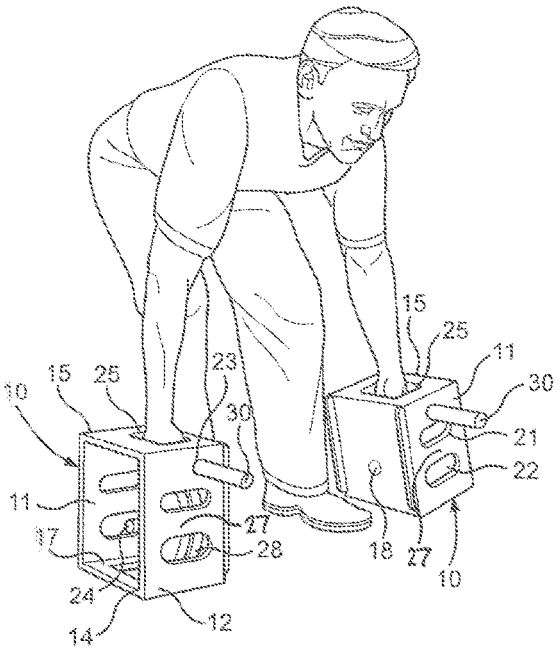
FIG. 20 depicts a side perspective view of a user holding two box training members by a first dowel member in a starting position of an exercise movement.
Figure 21:
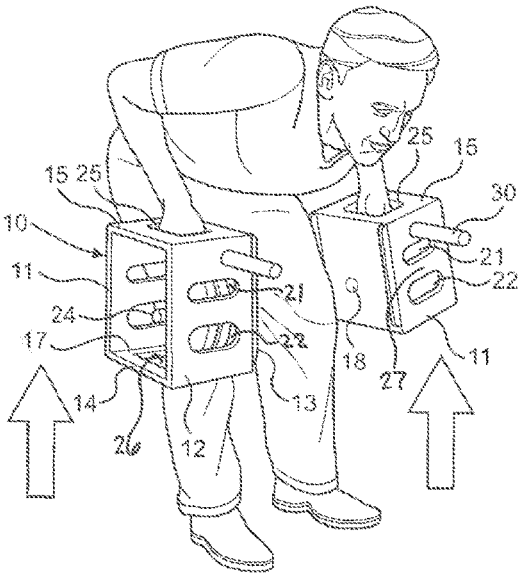
FIG. 21 depicts a side perspective view of a user holding two box training members by a first dowel member and performing an exercise movement.

FIG. 20 depicts a side perspective view of a user holding two box members 10 each by first dowel member 30 in a starting position of an exercise movement. First and second side members 11 and 12 each comprise circular apertures 23, wherein circular apertures 23 are aligned and positioned to allow for first dowel member 30 to be slidably received through said circular apertures 23. Further, top member 15 comprises opening 25, thereby allowing user to reach through opening 25 and grasp first dowel member 30, thus allowing dowel member 30 to be utilized as an additional hand grip for the box training assembly 100 of the present invention. Additionally, as illustrated in FIG. 20, circular apertures 23 are positioned off center—that is, between the mid-point of said first and second side members 11 and 12, and back member 13—thereby allowing a user to hold two box training assemblies 100 closer to his or her body, thus mimicking a more natural, anatomically advantageous standing position for a human body. As a result, user is able to hold two box members 10 simultaneously (one in each hand) and perform a variety of different exercises and exercise movements. FIG. 21 depicts a side perspective view of a user holding two box members 10 by first dowel member 30 and performing an exercise movement.

Figure 22:
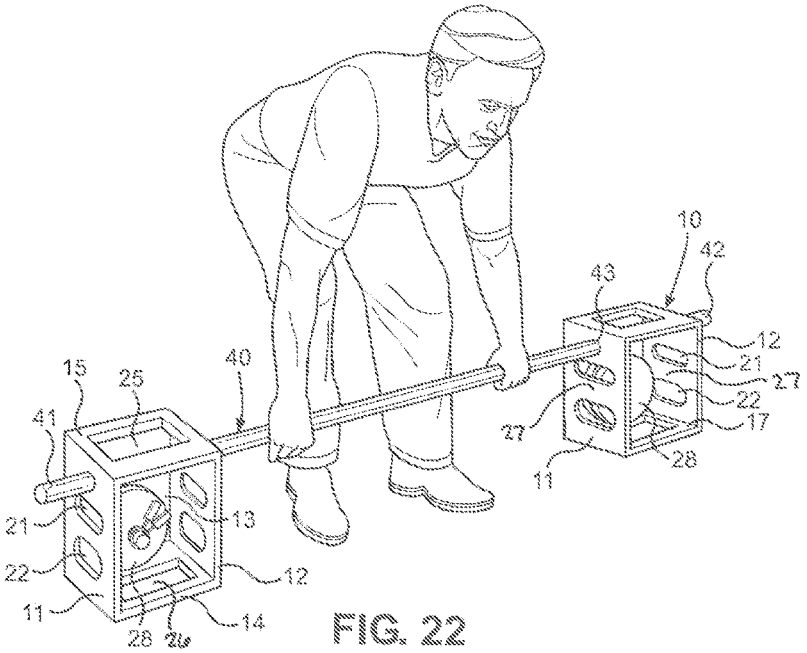
FIG. 22 depicts a side perspective view of a user holding two box training members by a second dowel member in a starting position of an exercise movement.

FIG. 22 depicts a side perspective view of a user holding two box training assemblies 100 by second dowel member 40 in a starting position of an exercise movement. As depicted in FIG. 22, box training assembly 100 comprises second dowel member 40. Second dowel member 40 comprises a substantially cylindrical shape and is used to connect multiple box members 10 in order to provide an alternate method of exercise training. Thus, circular apertures 23 of first side member 11 and second side member 12 are aligned to allow for second dowel member 40 to be slidably received through said aligned apertures 23 and extend between said first side member 11 and said second side member 12 of each box member 10. In such a configuration, second dowel member 4 provides a secure hand grip in order for a user to perform a variety of different exercise movements when multiple box training assemblies 100 are connected in this manner.

Figure 23:
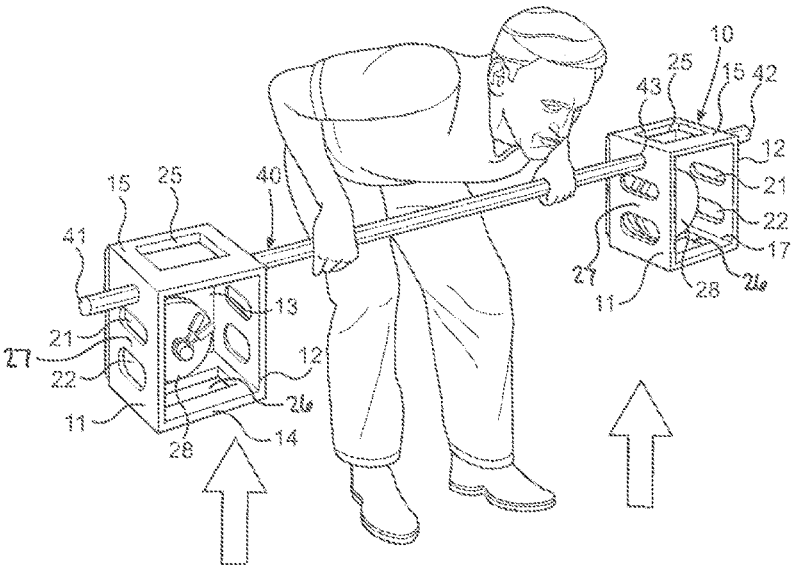
FIG. 23 depicts a side perspective view of a user holding two box training members by a second dowel member while performing an exercise movement.

FIG. 23 depicts a side perspective view of a user holding two box training assemblies 100 using second dowel member 40 while performing an exercise movement. It is to be observed that second dowel member 40 is relatively longer than first dowel member 30. Second dowel member 40 allows for a user to be positioned between multiple weight sources; thus, as a result, second dowel member 40 comprises a length that is necessary to be able to hold and connect multiple box training assemblies 100 simultaneously. Conversely, first dowel member 30 is relatively shorter than second dowel member 40. As a result, first dowel member 30 allows a user to be able to hold only one box training assembly 100 with said first dowel member 30.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A strength training apparatus comprising:

a) a box member comprising:

i) a first planar side member having a first plurality of elongated apertures, wherein said first plurality of elongated apertures cooperate to define a first hand grip member between said first plurality of elongated apertures;

ii) a second planar side member oriented parallel to said first planar side member and having a second plurality of elongated apertures, wherein said second plurality of elongated apertures cooperate to define a second hand grip member between said second plurality of elongated apertures;

iii) a third planar side member attached to said first and second planar side members and oriented perpendicular to said first and second planar side members, and having at least one aperture therein;

iv) a fourth planar side member attached to said first and second planar side members and oriented perpendicular to said third planar side member, and having at least one aperture therein;

v) a planar back member attached to at least one of said first planar side member, said second planar side member, said third planar side member, or said fourth planar side member; and b) a rigid post attached to said planar back member, and disposed between said first planar side member, said second planar side member, said third planar side member, and said fourth planar side member.

2. The strength training apparatus of claim 1, wherein a longitudinal axis of said rigid post is oriented perpendicular to said planar back member.

3. The strength training apparatus of claim 2, further comprising at least one weight plate disposed on said rigid post.

4. The strength training apparatus of claim 1, wherein said first planar side member has a midpoint, and said first hand grip member is disposed at said midpoint.

5. The strength training apparatus of claim 4, wherein said second planar side member has a midpoint, and said second hand grip member is disposed at said midpoint.

6. The strength training apparatus of claim 1, wherein said first hand grip member and said second hand grip members are each oriented perpendicular to said planar back member.

7. The strength training apparatus of claim 1, wherein said first hand grip member and said second hand grip members are aligned with each other.

8. The strength training apparatus of claim 1, further comprising:

a) a first circular aperture in said first planar side member;

b) a second circular aperture in said second planar side member, wherein said first and second circular apertures are aligned with each other; and c) a dowel disposed through both said first circular aperture and said second circular aperture.

9. A strength training apparatus comprising:

a) a box member comprising:

i) a first planar side member having a midpoint and a first plurality of elongated apertures, wherein said first plurality of elongated apertures cooperate to define a first hand grip between said first plurality of elongated apertures;

ii) a second planar side member oriented parallel to said first planar side member and having a midpoint and a second plurality of elongated apertures, wherein said second plurality of elongated apertures cooperate to define a second hand grip between said second plurality of elongated apertures;

iii) a third planar side member attached to said first and second planar side members and oriented perpendicular to said first and second planar side members, and having at least one aperture therein;

iv) a fourth planar side member attached to said first and second planar side members and oriented perpendicular to said third planar side member, and having at least one aperture therein;

v) a planar back member having a midpoint, wherein said planar back member is attached to at least one of said first planar side member, said second planar side member, said third planar side member, or said fourth planar side members, and wherein said first planar side member, said second planar side member, said third planar side member, said fourth planar side members and said planar back member cooperate to define an internal chamber; and b) a rigid post attached to said planar back member and extending into said internal chamber, wherein said rigid post has a longitudinal axis and said longitudinal axis is oriented perpendicular to said planar back member.

10. The strength training apparatus of claim 9, further comprising at least one weight plate removeably disposed on said rigid post.

11. The strength training apparatus of claim 9, wherein said first and second hand grips are oriented perpendicular to said planar back member.

12. The strength training apparatus of claim 9, wherein said first hand grip is disposed at said midpoint of said first planar side member, and wherein said second hand grip is disposed at said midpoint of said second planar side member.

13. The strength training apparatus of claim 9, wherein said first and second hand grips are aligned with each other.

14. The strength training apparatus of claim 9, wherein said rigid post is disposed between said midpoint of said planar back member and said third planar side member.

15. The strength training apparatus of claim 9, further comprising:

a) a first circular aperture in said first planar side member;

b) a second circular aperture in said second planar side member, wherein said first and second circular apertures are aligned with each other; and c) a dowel disposed through both said first circular aperture and said second circular aperture.

16. A strength training apparatus comprising:

a) a box member comprising:

i) a first planar side member having a midpoint and a first plurality of elongated apertures, wherein said first plurality of elongated apertures cooperate to define a first hand grip between said first plurality of elongated apertures;

ii) a second planar side member oriented parallel to said first planar side member and having a midpoint and a second plurality of elongated apertures, wherein said second plurality of elongated apertures cooperate to define a second hand grip between said second plurality of elongated apertures;

iii) a planar top member attached to said first and second planar side members and oriented perpendicular to said first and second planar side members, and having at least one aperture therein;

iv) a planar base member attached to said first and second planar side members and oriented perpendicular to said third planar side member, and having at least one aperture therein;

v) a planar back member having a midpoint, wherein said planar back member is attached to at least one of said first planar side member, said second planar side member, said third planar side member, or said fourth planar side member; and b) a rigid post attached to said planar back member, wherein said rigid post has a longitudinal axis and said longitudinal axis is oriented perpendicular to said planar back member.

17. The strength training apparatus of claim 16, wherein said first hand grip is disposed at said midpoint of said first planar side member, and wherein said second hand grip is disposed at said midpoint of said second planar member.

18. The strength training apparatus of claim 17, wherein said rigid post is disposed between said planar top member and said midpoint of said planar back member.

19. The strength training apparatus of claim 16, wherein said first and second hand grips are oriented perpendicular to said planar back member.

20. The strength training apparatus of claim 16, further comprising:

a) a first circular aperture in said first planar side member;

b) a second circular aperture in said second planar side member, wherein said first and second circular apertures are aligned with each other; and c) a dowel disposed through both said first circular aperture and said second circular aperture.

* * * * *